United States Patent [19]

Brown

[11] Patent Number: 4,487,361

[45] Date of Patent: Dec. 11, 1984

[54] HEAT EXCHANGER FLAME CONTROL

[75] Inventor: Claude D. Brown, Arvada, Colo.

[73] Assignee: BBC Industries, Inc., Grass Valley, Calif.

[21] Appl. No.: 432,074

[22] Filed: Sep. 30, 1982

Related U.S. Application Data

[63] Continuation-in-part of Ser. No. 237,822, Feb. 25, 1981, abandoned.

[51] Int. Cl.[3] ..... F24D 5/00

[52] U.S. Cl. ..... 236/11

[58] Field of Search ..... 236/9 R, 9 A, 11

[56] References Cited

U.S. PATENT DOCUMENTS 2,615,634 10/1952 Harbin, Jr. ..... 236/11 X 4,140,274 2/1979 Nabinger ..... 236/11

*Primary Examiner*—William E. Wayner

[57] ABSTRACT

A control circuit controls the delivery of fuel to a burner used to heat a heat exchanger in a furnace. A thermostat provides a fuel demand signal to a fuel valve causing the fuel valve to open to feed fuel to the burner to heat the heat exchanger. Once the heat exchanger is warmed to, for example, 250° the blower is activated by a low temperature switch. A high temperature safety switch is used to shut off the fuel valve if the temperature of the heat exchanger gets dangerously high, such as 800° F. A first switch is placed in series with the thermostat and the fuel valve and remains closed until the temperature of the heat exchanger rises above a first temperature, for example 500° F. When this occurs the first switch opens so the flame extinguishes. Once the heat exchanger temperature drops to a second temperature, such as 350° F., the first switch closes, thus resupplying fuel to the burner. This cycling ensures that the temperature of the heat exchanger remains at an efficient, but comfort producing temperature range. To eliminate the possibility that the first switch may open before the blower is actuated, a normally closed third switch is placed parallel across the first switch. The third switch is opened, thus removing it from the circuit, whenever the blower is active.

5 Claims, 3 Drawing Figures

HEAT EXCHANGER FLAME CONTROL

CROSS-REFERENCE TO RELATED APPLICATIONS

This is a continuation-in-part application of a pending application Ser. No. 237,822 filed Feb. 25, 1981 and now abandoned. Also the invention has been disclosed to the Patent Office as Disclosure Document No. 090493, received May 5, 1980.

BACKGROUND OF THE INVENTION

The present invention relates to means for automatically controlling the heat demand cycle in a heat exchange unit such as a furnace. More specifically it relates to means for controlling the ON-flame or burn cycle in such a furnace in response to temperature responsive means associated with a heat exchange unit.

DESCRIPTION OF THE PRIOR ART

Prior art references known to applicant are set forth in accompanying Form 1244.

Most furnaces, and especially gas and oil fueled furnaces and similar heating units, generate heat by burning their fuel in or âdjacent to a heat exchanger. The heat exchanger distributes or otherwise places the heat energy into beneficial use. However, in most such units the fuel is burned in such a manner that heat is generated more rapidly than it can be used, or absorbed and circulated for beneficial use. Analysis and research indicates that in most such prior art heating systems 50% or more or the heat energy generated by the heating system is wasted and lost, for example through the chimney flue and the like. This is apparently due to the fact that state-of-the-art heat exchangers and their related systems cannot conduct or circulate the heat for beneficial use as fast as the heat is generated by the fuel which is continuously being burned.

Most such prior art heating systems, and especially home heating systems, are activated "ON" and "OFF" during what is known as a "heat demand cycle", controlled by one or more temperature responsive thermostat switches, or other ON-OFF means located, for example, in the space to which the heat is to be conducted. Normally, once a heat demand cycle is initiated fuel is fed to a burner, and the fuel is fired to an ON-flame status to heat a heat exchanger. Then the flow of fuel to the burner and the ON-flame cycle continue until the heat demand cycle is terminated. The heat demand cycle is terminated, for example, in response to a thermostat, in response to a heat sensor associated with the heat exchanger, in response to a time cycle, in response to a switch or in response to a combination of such controls. No prior art system is known which intermittently controls burning during a single heat demand cycle.

It is now postulated that by providing intermittent "ON-flame", and "OFF-flame" periods during a single heat demand cycle, in response to the temperature of the heat exchanger, then the total amount of heat generated can be reduced, the amount of heat energy beneficially utilized will be maximized, and the amount of fuel burned will be reduced, with a concommitant reduction in cost of operation.

SUMMARY OF THE INVENTION

The present invention overcomes the short comings of the prior art devices through the provision of a novel control circuit which includes temperature responsive means placed in the general area of a heating system heat exchanger. This temperature responsive means is connected in series with the heating system's control switch or a thermostat located in the to-be-heated area. This temperature responsive means is also connected in parallel with the heat circulator, if there is one, which heat circulator is associated with the heat exchanger. Such a heat circulator may be a fan or a fluid pump. Gravity systems may not require a circulator. As set forth in more detail below the system of the present invention controls the action of the heating unit fuel valve to create an intermittent flame, or ON-flame and OFF-flame cycles, during each heat demand cycle.

It is therefore an object, feature and advantage of the present invention to provide a new and improved heat exchange control circuit which conserves fuel by intermittently stopping the flow of fuel during each heat demand cycle, in response to the temperature of the heat exchanger, and which utilizes the heat stored in the elements of the heat exchanger during one or more OFF-flame periods of each heat demand cycle.

Another and further object of the present invention is to provide a novel heat exchange flame control circuit arrangement and method for conserving energy by reducing wasted heat in a heating furnace system or other such heating system.

Another and additional object of the invention is to provide a very simple, yet significantly effective improvement over any similar devices and systems of the prior art.

BRIEF DESCRIPTIONS OF THE DRAWINGS

The foregoing and other objects and advantages of the present invention will become apparent upon full consideration of the following detailed description and accompanying drawings in which.

DESCRIPTION OF THE PREFERRED EMBODIMENTS

Figure 1:
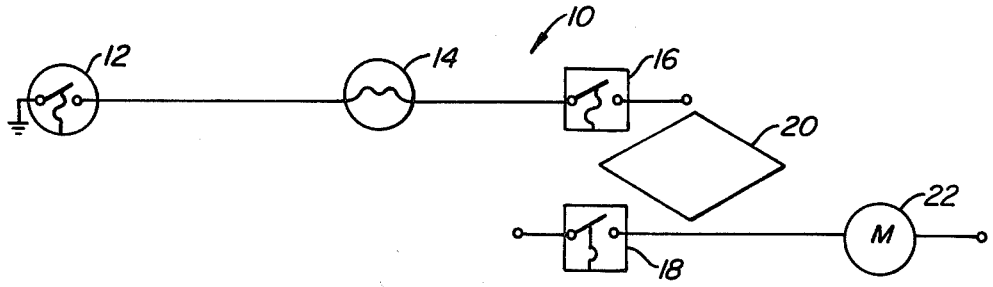
FIG. 1. PRIOR ART
FIG. 1 is an exemplary characterization of the known related prior art.

Referring now to the drawings, there is shown in FIG. 1 a prior art heating system and control circuit 10, having a thermostat or other control switch 12, normally open fuel valve circuit 14, normally closed high heat responsive limit control means 16 and normally open low heat responsive circulator control means 18, the latter two elements being closely located to diagramatically represented heat exchanger 20. All of these elements are connected to and powered by one or more conventional, usually low voltage, power source (not shown). Normally closed high heat responsive means 16 will open to shut off fuel valve 14 in response to a predetermined too high temperature at heat exchanger 20, while normally open low heat responsive means 18 closes to turn on circulator 22 once a predetermined minimum heat has been achieved at heat exchanger 20.

In operation, a signal from control switch 12 closes, and thus causes fuel to be passed by or through fuel valve circuit 14, by means not shown, to a burner, not shown, associated with heat exchanger 20. The fuel is ignited to an ON-burn cycle, and is burned to raise the temperature of heat exchanger 20. Diagramatically represented heat exchanger element 20, exemplary of the type used in state-of-the-art heating systems, is associated with means (not shown) for conducting heat from the furnace to heat distribution elements (not shown) throughout the area served by the heating system. This is accomplished by circulating means 22 which moves fluids (air, water, etc.) by or through exchanger 20, where the fluids are heated and conveyed throughout the area served by the heating system. However, in the operation of such prior art systems, once an ON-burn sequence is initiated, fuel continues to flow through valve 14, and fuel is burned continuously throughout the heat demand cycle.

Figure 2:
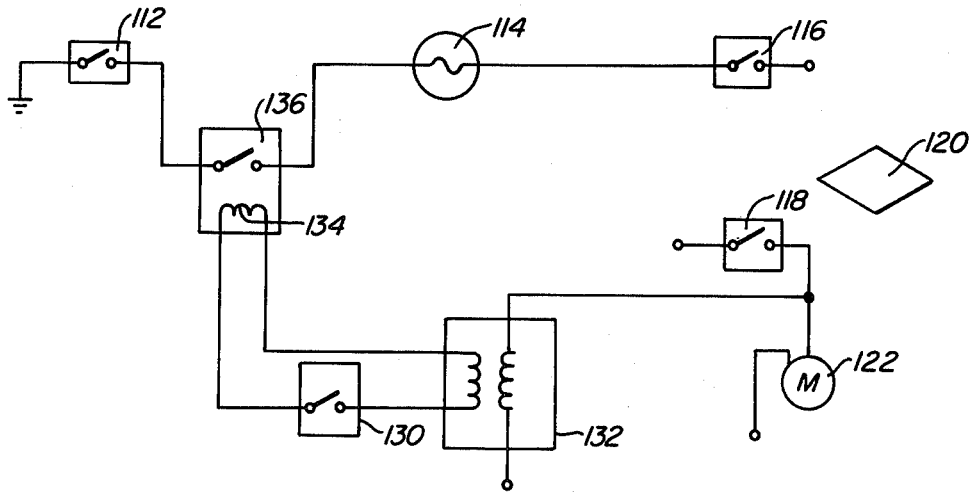
FIGS. 2 and 3 are composite schematic and circuit diagrams of heating systems incorporating preferred embodiments of the circuits of the present invention.

The present invention differs from the prior art. In one preferred embodiment of the present invention, shown and illustrated diagramatically and schematically by FIG. 2, the normally open main thermostat or control switch 112, normally open fuel valve circuit 14, heat exchanger 120, normally closed high heat responsive limit control means 116, and normally open low heat responsive-circulator control means 118, are connected to provide a conventional control circuit in any well-known manner, for example similar to that of the prior art, illustrated by FIG. 1. Control 112, fuel valve circuit 114 and high heat switch 116 operate in series on a conventional, usually low voltage source (not shown), as is well known in the art. Circulating means 122 is usually connected to a high voltage (house voltage) energy source (not shown), and operates in response to low heat responsive control 118. However, as an improvement of the present invention, a normally open temperature responsive control 130 is provided. Temperature responsive switch 130 is energized by, for example, transformer 132. Temperature responsive switch 130 is also operatively connected to relay coil 134 which controls normally closed relay switch 136, as shown in FIG. 2. While not immediately apparent from FIG. 2, temperatures responsive means 130 is preferably physically located in the vicinity of heat exchanger 120 so that it may detect the temperature variations of the heat exchanger.

In operation, as with the prior art, when main switch or thermostat 112 is turned on (closed), it completes a circuit through normally closed relay 136 and normally closed high temperature responsive means to close fuel valve 114. This causes fuel to pass to and be ignited by burners, not shown, associated with heat exchanger 120. When a predetermined temperature is reached in the vicinity of heat exchanger 120, normally open low heat responsive switch 118 closes, causing circulator 122 to operate and move to-be-heated fluids by or through heat exchanger 120.

However, in the operation of the present invention, when normally open temperature responsive switch 130 detects a predetermined temperature, the contact of switch 130 closes, thereby completing the circuit through relay coil 134. Then, in response to current flowing through relay coil 134, normally closed relay switch 136 is caused to open, thus disrupting the circuit to fuel valve 114. When fuel valve circuit 114 becomes inoperative (is opened) it disrupts the ON-flame status of the burners, even though the heat demand cycle of switch 112 may still call for heat. During this disruption of valve 114, the temperature of heat exchanger 120 is initially high, and heat from heat exchanger 120 is put to beneficial use by circulator 122. Thus the high retained heat of heat exchanger 120 is not wasted.

As heat exchanger 120 cools, for example, as a result of heat circulating device 122 removing heat, heat responsive element 130 senses the drop in temperature, thereby allowing normally open heat responsive switch element 130 to re-open. The opening of switch 130 then opens or disrupts the circuit to relay coil 134 of control switch 136, thus in turn allowing switch 136 to resume its normally closed position. Then, with the closing of switch element 136 the circuit to fuel control valve 114 is once again completed allowing the operation (closing) of fuel valve circuit 114, transmission and firing of fuel, and additional heating of heat exchanger 120.

Thus, in the practice of the present invention, such ON-flame, OFF-flame cycles will continue intermittently, in response to the heating (closing) and cooling (opening) of heat responsive switch 130, throughout each heat demand cycle. When the room temperature is sufficiently high, or when thermostat or switch 112 is otherwise caused to open, the circuit to the fuel valve 114 will be opened to end the heat demand cycle. If normally open temperature responsive switch 118 is closed, fluid circulator 122 will continue to operate until switch 118 opens.

In the embodiment shown in FIG. 2, temperature responsive switch 130 is energized through transformer 132, and thus is only operative when normally open low temperature responsive switch is closed. Therefore, in preferred embodiment of FIG. 2, heat responsive means 130 is normally set to close at a temperature higher than low heat responsive switch 118. A simple modification (not shown) of FIG. 2, would provide energization to temperature responsive switch 130 and relay coil 134 independently of switch 118. In such a configuration switch 130 would be capable of operating regardless of the status of switch 118. This latter arrangement would also allow temperature responsive switch 130 to be set at a predetermined temperature lower than the temperature of switch 118.

Figure 3:
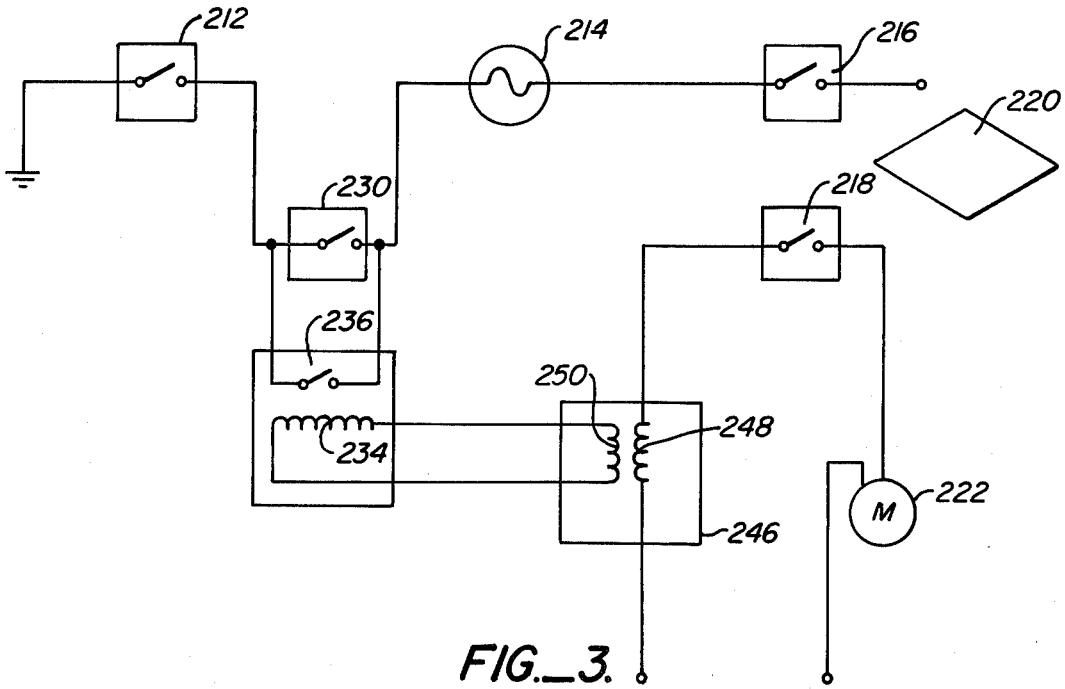

Another embodiment of the present invention is illustrated in FIG. 3. In this system control switch or thermostat 212, fuel valve circuit 214, high heat responsive limit control means 216, low temperature responsive circulator control means 218, heat exchanger 220, and circulator pump or fan means 222 all operate, substantially as their counterparts described in FIGS. 1 and 2.

The preferred embodiment of FIG. 3 is most representative of the type of system which is used with a standard home or other type of heating furnace. Various heat sensing and timing devices are normally associated with such a furnace, and these devices might be set in such a manner that the heat limiting circuit of the present invention may become activated to cause on OFF-burn condition before normally open low temperature responsive sensor 218 is heated to a temperature which causes it to close and activate circulator 222. However, the substantially continuous activity of heat circulator 222 during each heat demand cycle is desired in order.to increase the efficiency of the present system. The embodiment set forth in FIG. 3 assures the ability of circulator 222 to become activated, regardless of when the heat limiting circuit of the present invention is activated. It also allows the heat limiting circuit of the present invention to operate intermittently during each heat demand cycle.

In this embodiment, a normally closed heat responsive switch 230, which is actually juxtaposed to heat exchanger 220, is in series relation between control switch or thermostat 212 and fuel valve 214. In the same circuit, in parallel relationship to temperature responsive switch 230, is normally closed relay switch 236. When closed, relay 236 serves as a shunt to by-pass or override temperature responsive switch 230. Relay 236 is associated with activating coil 234 which is energized to open normally closed relay 236 when normally open low temperature responsive switch 218 is closed to activate circulator 222. In the embodiment shown in FIG. 3, this energization of coil 234 is accomplished by means of transformer 246. Transformer 246 includes high power source primary winding 248 and secondary winding 250. Winding 250 is continuously coupled to activating coil 234. By this arrangement, the closing of normally open low temperature responsive switch 218 energizes primary winding 248 of transformer 246, which in turn energizes secondary winding 250 and associated activating coil 234. When coil 234 is activated, normally closed relay 236 is opened, and relay 236 can no longer serve as a by-pass of temperature responsive switch 230.

In the operation of the embodiment of FIG. 3, a heat demand cycle is initiated by activating switch or thermostat 212. This completes a circuit through both parallel normally closed temperature responsive switch 230 and normally closed relay 236 to fuel valve 214. The activation of fuel valve 214 causes the flow of fuel to burners (not shown) which initiates an ON-burn cycle to raise the temperature of heat exchanger 220. Then, if normally open low temperature responsive switch 218 is heated to a predetermined temperature which causes switch 218 to close before normally closed temperature responsive switch 230 is caused to open, then activating coil 234 is activated in response to the energization of primary winding 248 of transformer 246 activating secondary winding 250 when switch 218 is closed. This in turn causes normally closed switch 236 to open. Thereafter, switch 218 will normally remain closed during the balance of the heat demand cycle (and usually beyond) so that temperatures responsive switch 230 thereafter becomes the sole controlling element in the continued or intermittent operation of fuel valve circuit 214.

Similarly, in the initial operation of the embodiment of FIG. 3, if after the ON-flame cycle is initiated, normally closed temperature responsive switch 230 is activated open before normally open low limit switch 218 is closed, then, rather than disrupting fuel valve circuit 214 to cause an OFF-flame cycle, the circuit to fuel valve 214 remains complete through the by-pass provided by a normally closed relay 236. Thus heating of heat exchanger 220 continues at least until normally open low temperature responsive switch 218 is caused to close, with the concommittant activation of circulator 222. As previously described, after switch 218 is closed then coil 234 is energized, causing relay 236 to be opened and remain open, with the result that during the balance of the heat demand cycle temperature responsive switch 230 becomes the sole controlling element in the continuous or intermittent operation of fuel valve 214.

In the system of FIG. 3, after operation of a heat demand cycle and when switch 218 reopens, then relay switch 236 also returns to its normally closed position so that it is ready for the next heat demand cycle.

Temperature responsive switches 16, 116 and 216 have been referred to as a safety shut-off device. By this it is meant that such a switch is heat responsive and is activated at a predetermined high temperature to open (disrupt) the operation of the fuel valve should the temperature of the heat exchanger become too high. Temperature responsive switches 18, 118 and 218 have been referred to as a low temperature responsive control switches. By this it is meant that such a normally open switch closes at a preselected low temperature in the vicinity of the heat exchanger. Switches 18, 118 and 218 permit a warm up period for the heat exchanger after the heater flame comes on. If switches 18, 118 or 218 were normally closed, or if they closed before the warm-up of the heat exchanger then cold fluid would be moved by the heat circulating system.

The control circuit of the present invention, in general, can be utilized with a furnace having no circulator pump, for example with a gravity hot air system, and therefore without a low temperature responsive switch. As the high temperature responsive switch is only a safety mechanism, its presence, while desirable, is not required. As used herein a "fuel valve" is any device which controls the flow of the fuel to the heating system.

Additional embodiments of the present invention will be apparent to those skilled in the art. It is therefore intended that the scope of the invention be limited only by the appended claims and the prior art and not by the preferred embodiments described herein. Accordingly, reference should be made to the following claims in determining the full scope of the present invention.

What is claimed is:

1. A flame control system for use with heat exchange systems of the type including a thermostat for initiating and terminating a heat demand cycle, a burner coupled to a fuel valve, the fuel valve being responsive to a heat demand signal from the thermostat, and a heat exchanger proximate the burner, the control system comprising:

a temperature responsive first switch means, placed in series with the thermostat and the fuel valve, for preventing the application of the heat demand signal to the fuel valve when the temperature of the heat exchanger rises above a first temperature so the flow of fuel to the burner is halted upon the opening of said first switch means, and for permitting the reapplication of the heat demand signal to the fuel valve when the temperature of the heat exchanger drops below a second temperature so the fuel to the burner is restarted upon the closing of said first switch means;

a fluid circulator arranged and adapted to remove heat from the heat exchanger;

a normally open second switch, responsive to the temperature of the heat exchanger and operably coupled to said fluid circulator, adapted to close and activate said circulator when the temperature of the heat exchanger rises above a third temperature;

a normally closed third switch placed in parallel across said first switch means; and means for opening said third switch when said second switch is closed so that the heat demand signal from the thermostat to the fuel valve cannot be disrupted until after said fluid circulator has been activated.

2. The system of claim 1 wherein said fluid circulator is an air blower.

3. The system of claim 1 wherein said third temperature is lower than either of said first or second temperatures.

4. The system of claim 1 wherein said third switch opening means includes a transformer in series with said second switch, said transformer including a secondary winding in a series loop with an actuator coil arranged and adapted to open said normally closed third switch when energized by said secondary winding.

5. A flame control system for use with heat exchange systems of the type including a thermostat for initiating and terminating a heat demand cycle, a burner coupled to a fuel valve, the fuel valve being responsive to a heat demand signal from the thermostat, a heat exchanger proximate the burner, a fluid circulator arranged and adapted to remove heat from the heat exchanger, and a normally open fluid circulator switch, responsive to the temperature of the heat exchanger and operably coupled to the fluid circulator, adapted to close and activate the circulator when the temperature of the heat exchanger rises above a certain temperature, the control system comprising:

a temperature responsive first switch means, placed in series with the thermostat and the fuel valve, for preventing the application of the heat demand signal to the fuel valve when the temperature of the heat exchanger rises above a first temperature so the flow of fuel to the burner is halted upon the opening of said first switch means, and for permitting the reapplication of the heat demand signal to the fuel valve when the temperature of the heat exchanger drops below a second temperature so the fuel to the burner is restarted upon the closing of said first switch means;

a normally closed third switch placed in parallel across said first switch means; and means for opening said third switch when the fluid circulator switch is closed so that the heat demand signal from the thermostat to the fuel valve cannot be disrupted until after said fluid circulator has been activated.

* * * * *